US005980199A

United States Patent [19]

Godichon

[11] Patent Number: 5,980,199

[45] Date of Patent: Nov. 9, 1999

[54] PERFORMANCE CENTRIFUGAL BLOWER APPARATUS INCLUDING AT LEAST TWO SUCTION INLETS, AND ASSOCIATED BLOWER METHOD

[75] Inventor: Alain Emile Godichon, Saint-Remy, France

[73] Assignee: ABB Soylvent-Ventec, France

[21] Appl. No.: 08/900,782

[22] Filed: Jul. 25, 1997

[30] Foreign Application Priority Data

Aug. 7, 1996 [FR] France ..... 96 10135

[51] Int. Cl.[6] ..... F04D 29/46

[52] U.S. Cl. ..... 415/1; 415/94; 415/102; 415/150; 415/155

[58] Field of Search ..... 415/1, 94, 95, 415/101, 102, 150, 155, 151, 159, 160, 162, 163

[56] References Cited

U.S. PATENT DOCUMENTS

| | | | |
|---|---|---|---|
| 713,457 | 11/1902 | Kuderer | 415/155 |
| 2,050,700 | 8/1936 | Hagen | 415/160 |
| 2,073,404 | 3/1937 | Hobbs et al. . | |
| 2,201,437 | 5/1940 | Kice, Jr. | 415/155 |
| 2,814,432 | 11/1957 | Eiserman . | |
| 3,625,629 | 12/1971 | Morrison et al. . | |
| 3,960,527 | 6/1976 | Goettl | 415/151 |
| 5,324,167 | 6/1994 | Moczadlo et al. . | |

FOREIGN PATENT DOCUMENTS

| | | | |
|---|---|---|---|
| 30289 | 11/1924 | France | 415/94 |
| 25 38 066 | 3/1977 | Germany . | |
| 631679 | 11/1978 | U.S.S.R. | 415/102 |
| 130521 | 8/1919 | United Kingdom . | |
| 532758 | 1/1941 | United Kingdom . | |

*Primary Examiner*—Christopher Verdier
*Attorney, Agent, or Firm*—Nixon & Vanderhye P.C.

[57] ABSTRACT

A centrifugal blower apparatus suitable for industrial uses has a least a delivery outlet and at least two fluid inlets disposed on either side of a blower wheel suitable for being rotated by a drive system. Each inlet is associated with a respective control system for controlling the suction flow rte of fluid and is capable of establishing asymmetrical suction flow rates between the inlets. The inlets are fitted with control systems which differ in their mechanical structures and their characteristics concerning fineness of control.

18 Claims, 5 Drawing Sheets

PERFORMANCE CENTRIFUGAL BLOWER APPARATUS INCLUDING AT LEAST TWO SUCTION INLETS, AND ASSOCIATED BLOWER METHOD

FIELD OF THE INVENTION

The present invention relates to the general technical field of centrifugal blower type methods and apparatuses, including at least two suction inlets for the fluid to be blown, disposed laterally and facing the blower wheel.

The present invention relates to a centrifugal blower apparatus including at least one delivery section and at least two fluid inlets disposed on either side of a blower wheel which is suitable for being rotated by drive means, each inlet being associated with a fluid control system suitable for creating a suction flow that is asymmetrical between the inlets.

The present invention also relates to a method of centrifugally blowing a fluid, in which the fluid to be blown is sucked continuously and successively by a centrifugal wheel through at least two inlets situated on either side of the wheel to create at least one suction flow, the suction flow rate is controlled in asymmetrical manner between the inlets by using respective control systems associated with each inlet, and the suction flow is expelled by the centrifugal wheel through a common delivery outlet.

BACKGROUND OF THE INVENTION

Large capacity blowers for industrial use are already well known and widespread in numerous sectors of industry. Such blowers can be applied in sectors of industry that are as varied as: the nuclear industry, the chemical industry, the iron and steel industry, the cement Industry, for example, or Indeed in fossil fuel power stations.

In these industrial applications, it is conventional to distinguish between two major type. of blower unit: centrifugal type blower units; and axial type blower units; it being understood that the present invention relates more particularly to centrifugal type blowers in which the fluid to be blown is sucked in laterally relative to the blower wheel through At least two inlets, and is then expelled by the centrifugal force created by the vanes of the blower wheel.

Given the large ventilation capacities required by the above-mentioned industrial applications, for example of the order of 500 kW to 5000 kW, and indeed in extreme cases 100 kW to 10,000 kW, blower unit designs are of large dimensions, even though such units are made up of moving parts which are subject in use to high stresses, mechanically, in terms of duration of operation, and in terms of the conditions of the medium in which the parts need to operate.

A recognized consequence is that criteria such as operational effectiveness, technical reliability, noise level, and operating cost, including the notion of blower efficiency, are of very great importance when designing and using such devices.

Proposals have thus already been made to control and vary the suction flow rate of two-inlet centrifugal blowers in order to reduce the power they absorb, for the purpose of obtaining aerodynamic control of the flow rate of the device, necessary for better efficiency and thus for guaranteed savings.

Thus, it is already known to reduce the flow rate of two-inlet centrifugal blowers in a given circuit by fitting them with air-deflector elements such as deflectors or suction dampers. A deflector is formed by a circular disposition of blades mounted at a suction inlet on one side or the other of the blower wheel to turn about respective radial axes, e.g. centered on the axis of the wheel. A suction damper is likewise formed by a set of blades mounted in a cover, with the ability to be turned or varied in angular pitch about parallel axes.

In both the above-described prior art embodiments, the deflector elements are functionally connected to at least one means for controlling their position and pitch, and to conventional drive means such as a servo-motor. It is thus possible to position the deflector elements associated with an inlet so as to vary the suction flow rate.

It is known that by tilting the deflector elements in an appropriate manner, a rotary flow of air is created at the inlet to the blower wheel, which flow is usually directed to rotate in the same direction as the blower wheel. Compared with other systems for controlling the flow in the circuit, this rotary air flow has the consequence of reducing the power absorbed by the blower. When the angular displacement of the deflector elements associated with each inlet is obtained in symmetrical manner, the suction flow rate is identical or substantially identical through each inlet, and the results obtained with such apparatuses are represented by curve c shown in FIG. 1. Depending on the pitch of the deflector elements and on the operating conditions of the blower, expressed in percentage terms as a function of the maximum rate authorized for the installation, this curve shows how efficiency varies as a function of flow rate on a given installation, with the resistance of the system varying in proportion with the square of the flow rate.

It is generally considered that such flow rate control systems give overall satisfaction since they make it possible to achieve a relative improvement in device efficiency, Nevertheless, it turns out that the efficiencies obtained are insufficient, particularly in the normal operating ranges of blower units, corresponding, for example, to operating at partial loads of the order of 40% to 80%.

To improve the efficiency of blower units operating under partial load, proposals have already been made in Published German application No. 2538066, in the case of centrifugal blowers fitted with deflector control systems, to control the orientation of the deflectors of one inlet asynchronously or asymmetrically relative to the other. This asymmetry of operation in the suction flow makes it possible to achieve a significant improvement in the efficiency of a blower unit when partially loaded. Nevertheless, it appears that the economic optimum operating range for such devices is obtained at high partial loads.

Also, the cost of such apparatuses, particularly for high power blower machines, turns out to be a factor that can limit the use thereof.

OBJECTS AND SUMMARY OF THE INVENTION

Consequently, an object of the present invention is to improve the above-mentioned blower methods and apparatuses and to propose a centrifugal blower apparatus and method in which efficiency is at a maximum at all partial operating loads, and in which manufacturing and operating costs are low, Another object of the invention is to propose a novel centrifugal blower method and apparatus in which efficiency improvements are obtained by means of techniques that are particularly simple to implement.

An additional object of the invention is to propose a novel centrifugal blower method and apparatus that is particularly simple to adapt from the structure of most existing centrifugal blowers without changing the general operating constraints thereof.

Another object of the invention is to propose a novel centrifugal blower method and apparatus in which headlosses are limited.

The objects of the invention are achieved by means of a centrifugal blower apparatus capable of operating at partial load and including at least one delivery outlet and at least two fluid inlets disposed on either side of a blower wheel which is suitable for being rotated by drive means, each inlet being associated with a control system for controlling the fluid suction flow and suitable for establishing suction flow rates that are asymmetrical between the inlets to enable said apparatus to operate at partial loads, wherein the inlets are fitted with control systems that are not identical, differing in their mechanical structures and their characteristics relating to fineness of control so as to govern and model the shape of the control curve at all partially loaded operating rates.

The objects of the invention are also achieved by means of a method of centrifugally blowing a fluid by means of a blower unit capable of operating under partial load, in which the following are performed continuously and successively:

the fluid to be blown by a centrifugal wheel is sucked in through at least two inlets situated on either side of the wheel to create at least one suction flow;

the suction flow rate is controlled asymetrically between the inlets by means of respective control systems associated with the inlets to enable the blower unit to operate at partial load; and the suction flow is expelled by the centrifugal wheel via a delivery outlet, the method consisting in controlling the suction flow rate by means of control systems having different relative finenesses of control for each inlet so as to govern and model the form of the control curve at all partially loaded operating rates.

BRIEF DESCRIPTION OF THE DRAWINGS

Other details and advantages of the invention are described in greater detail in the light of the following description and illustrative examples, given purely as non-limiting examples, and in which.

MORE DETAILED DESCRIPTION

Figure 2:
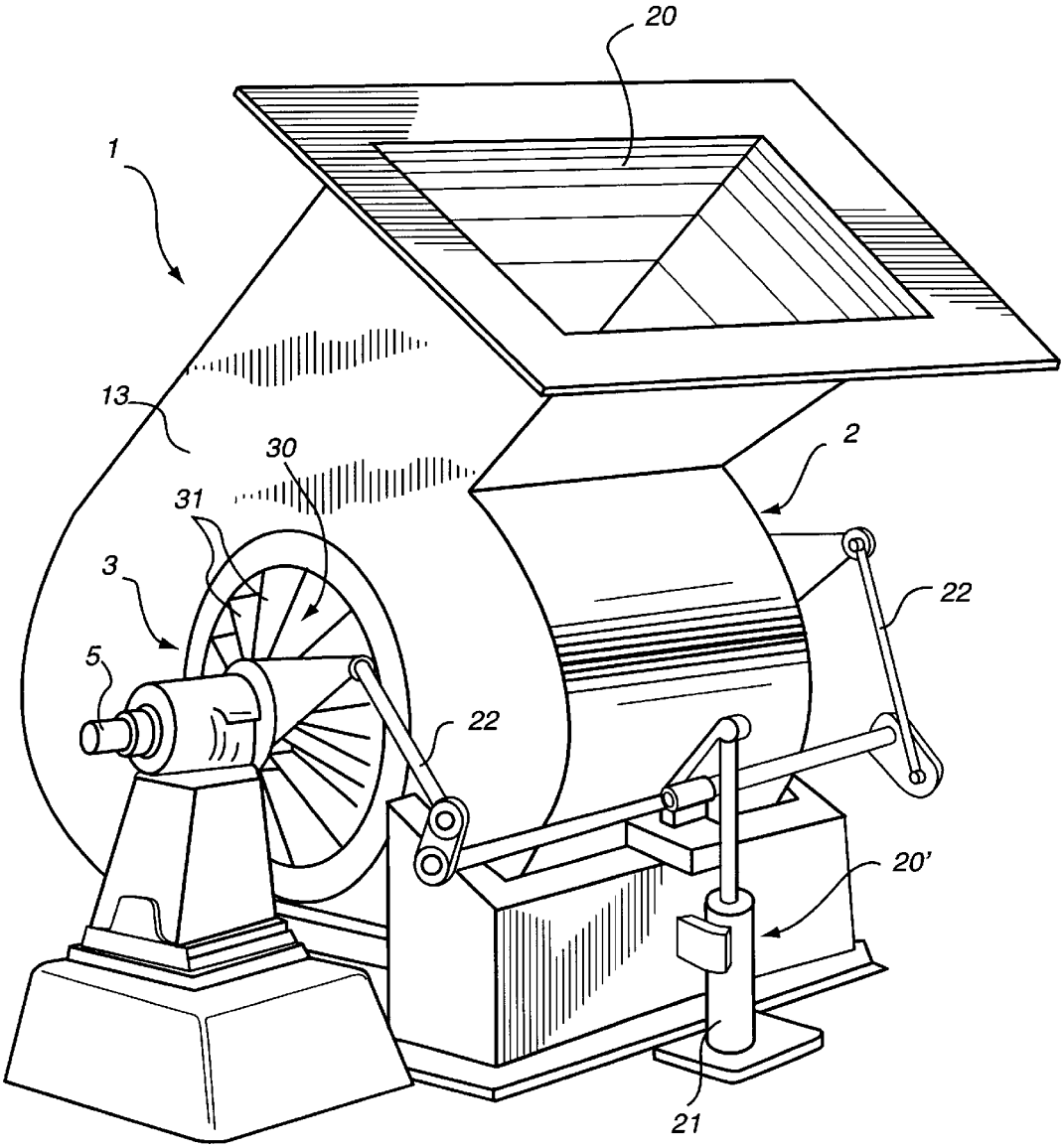
FIG. 2 is an overall perspective view of a two-inlet centrifugal blower of the invention.
Figure 3:
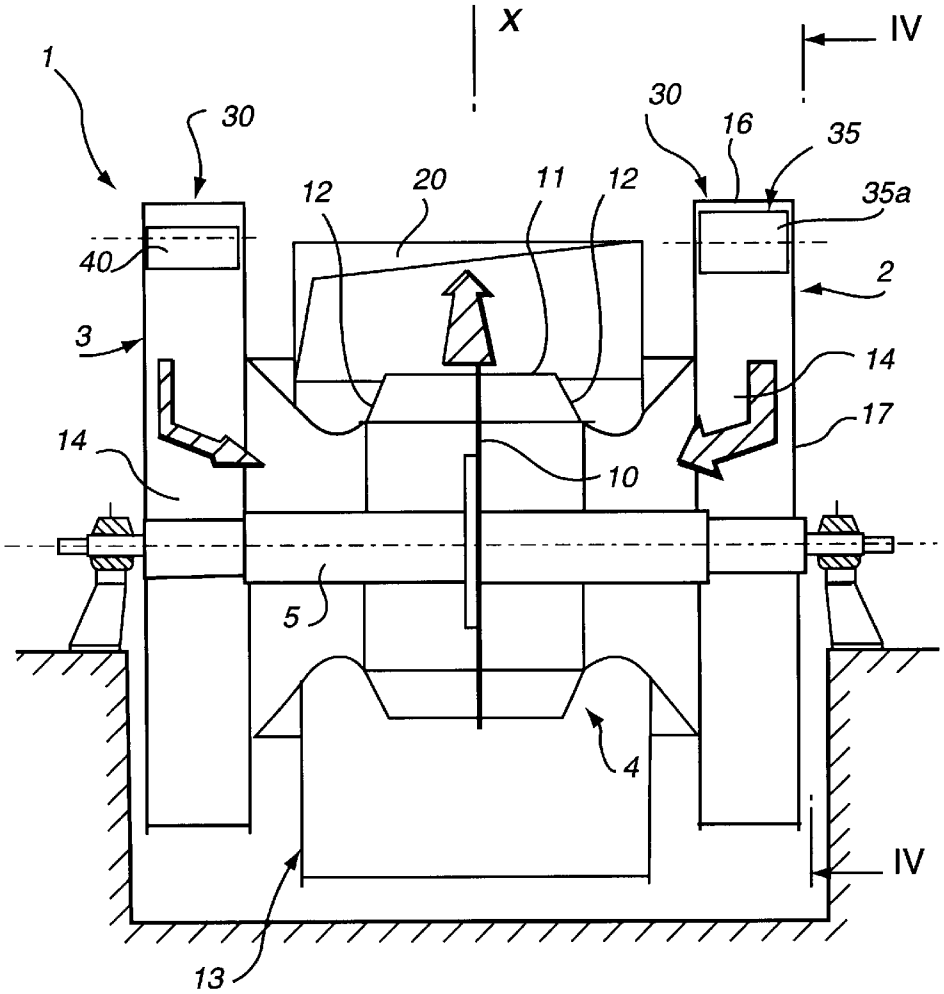
FIG. 3 is a general longitudinal section view through a first variant of a centrifugal blower of the invention.
Figure 5:
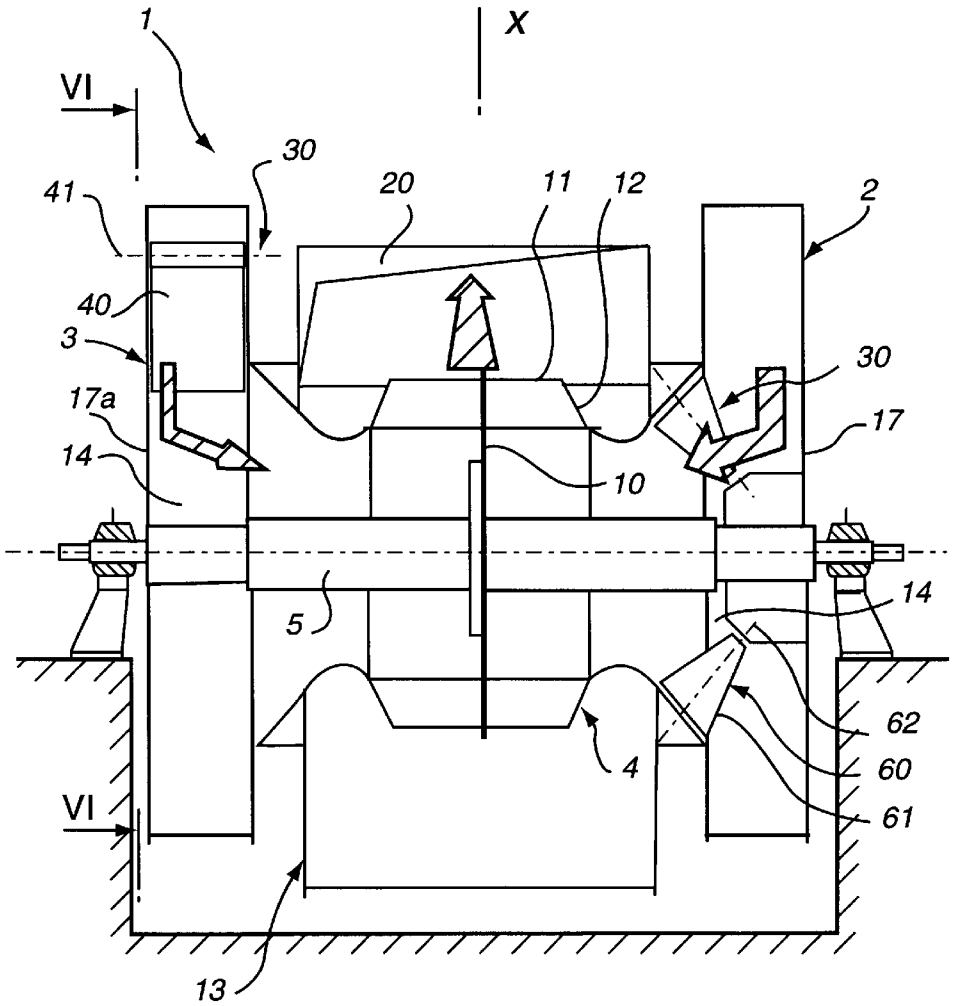
FIG. 5 is a longitudinal section through a second variant embodiment of a centrifugal blower of the invention.

FIGS. 2, 3, and 5 are general views of a centrifugal blower unit 1 operating under partial load, comprising at least two fluid inlets 2 and 3 disposed on either side of a blower wheel 4 rotatably mounted on a shaft 5, itself suitable for being rotated by drive means (not shown in the figures) such as an electric motor, for example.

The centrifugal blower unit 1 may be single, or on the contrary it may be integrated in blower apparatus comprising a plurality of centrifugal blower units.

In the meaning of the invention, the term "fluid" should be understood as covering any gas or gaseous mixture possibly carrying particles of any kind, e.g. Solid or liquid, it being understood that in the usual case the fluid to be blown has a composition that differs little from that of air.

In the simplest case, the inlets 2 and 3 are disposed laterally and symmetrically about the main axis of symmetry x–x' of the centrifugal blower 1, which it occupied by a central disk 10 whose two lateral faces are provided with respect series of vanes 11 covered by shrouds 12 of various profiles suitable for the type of centrifugal blower, for the characteristics of the fluid to be blown, and for its main use. By way of example, the shrouds 12 may be conical or plane. The assembly constituted by the central disk 10, the vanes 11, and the shrouds 12 constitutes a blower wheel 4 that is integrated in a main housing 13 that forms the general structure of the centrifugal blower 1. Each series of vanes 11 is associated with a respective inlet 2, 3 and, for each of these inlets, performs the function of individualized fluid feed to portions of the blower situated downstream. The auxiliary parts associated with the main housing are of conventional design well known to the person skilled in the art, and are consequently not described in greater detail.

Figure 4:
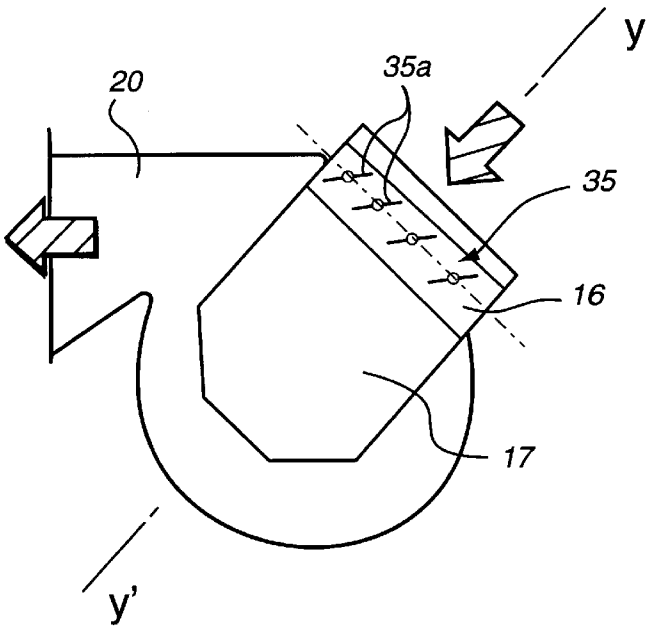
FIG. 4 is a fragmentary cross-section on line IV—IV of FIG. 3 showing a detail of said first variant embodiment.

In the embodiments shown in FIGS. 3 and 5, there are two separate inlets 2, 3, each having an internal channel 14 forming the suction section of the inlet, said channel being defined externally by a suction hood 17 covering each inlet 2, 3. As shown in FIG. 4, the main axis y–y' of the suction hood 17 can be tilted upwards from the horizontal. Advantageously, the section and the dimensions of the inlets 2, 3 and of the associated suction hoods 17 are identical.

The centrifugal blower 1 also includes at least one delivery outlet 20 disposed downstream from the centrifugal wheel 4 in the direction of fluid flow through the blower. In the embodiment shown in FIGS. 2 to 6, the delivery outlet 20 is central and lies on the general axis of symmetry x–x' of the centrifugal blower 1. In centrifugal blowers, the flows coming from each of the inlets 2 and 3 are mixed together in the case defining said outlet 20 immediately prior to the resulting single flow being expelled.

The centrifugal blower 1 or the invention is also provided with regulator means 30 for controlling the suction flow of fluid towards each of the inlets 2 and 3. The control systems 30 are formed by conventional means known in the prior art, such as deflector elements for varying the direction and the path of the fluid flowing through the inlets. By way of non-limiting example, FIG. 2 shows a deflector element constituted by a series of blades 31 constituting a deflector control system 30. Other control systems 30 can naturally be considered, such as damper systems or flap systems, as described in greater detail below. In conventional manner, the control systems 30 associated with the inlets 2 and 3 are connected to a partial load control System 20' for the blower as shown in FIG. 2. Said system 20' comprises a drive member 21 such as a servo-motor or a hydraulic actuator, and actuator means including, for example, a crank and connecting rod assembly 22 connected indirectly to the blades 31 so as to hold or modify the pitch thereof. Instead of a crank and connecting rod assembly 22, it is possible to use any technically equivalent means, such as gears or cams. As shown in FIG. 2, the control system 20' is common to both inlets 2 and 3 and has asymmetrical control members. In a variant, it is naturally possible to envisage controlling the deflector elements of each inlet 2 and 3 by means of respective separate crank and connecting rod assemblies, with each assembly being associated with a respective drive member 21.

According to the invention, the inlets 2 and 3 are fitted with control systems 30 which differ from each other in their mechanical structures and their characteristics relating to fineness of control. By installing control systems 30 that are not identical and that therefore possess different control performance, it is possible to establish asymmetrical suction flows through the two inlets 2 and 3. In the meaning of the invention, and as is well accepted in the technical field under consideration, the fineness of control of an apparatus in comparison with another apparatus is determined by the variation in the absorbed power that is necessary to operate the apparatus, it being understood that the comparison is performed at the same operating rate, i.e. at the same flow rate. In the context of the invention, the control systems 30 differ in fineness of control by at least 5%, and preferably by an amount lying in the range 5% to 20%.

Consequently, a centrifugal blower apparatus 1 of the invention has control systems 30 that are not identical, with the fineness of control provided for one of the inlets 2 being greater than that provided for the other inlet 3.

Figure 6:
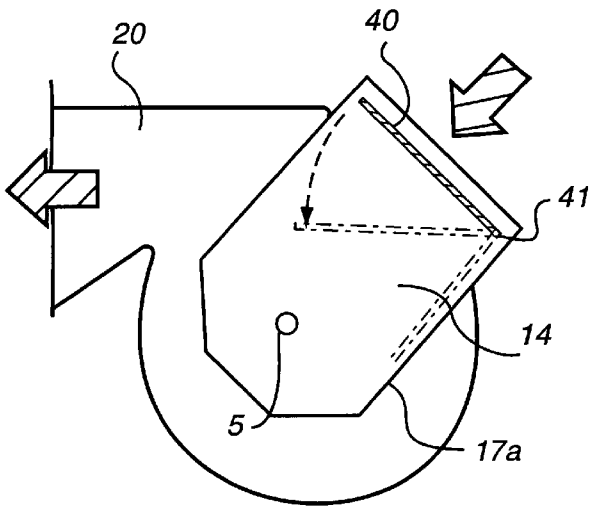
FIG. 6 is a cross-section on line VI—VI of FIG. 5 showing a detail of the second variant of the invention.

FIGS. 3 and 4 show a first variant embodiment of the invention in which the inlet 3 is provided with a moving closure control flap 40 while the inlet 2 is fitted with a control damper 35. In conventional manner, the deflector elements of the control damper 35 are constituted by a series of fins 35*a* mounted in a suction chamber 16 situated upstream from the suction channel 14 of the Inlet 2, and preferably forming the top portion of the inlet to the suction hood 17. The fins 35*a* are advantageously substantially rectangular in shape and are mounted side by side in the suction chamber 16 on the longitudinal axis of the inlet section of said chamber 16. In their "closed" position, corresponding to a reference angular position of 0°, the fins 35*a* are parallel to one another and advantageously extend across the entire suction section so as to make it possible to close off completely said suction section. The fins 35*a* can occupy any intermediate angular position in the range 0° to 90°, with the angular position corresponding to 90° defining the open position of the damper 35. The control and closing moving flap 40 is in the form of a substantially rectangular plate having one of its ends mounted to rotate about an axis 41 secured to the hood 17. Relative to the opening defining the inlet 2, the moving flap 40 can occupy any angular position between a closed position and an open position, for which the geometrical position correspondences are similar to those given above. Advantageously, the moving flap 40 is more particularly intended to operate discontinuously between a closed position and an open position, with the intermediate positions being practically unused. FIG. 3 shows the moving flap 40 in a closed or substantially closed position while FIG. 5 shows the moving flap 40 in an open position. FIG. 6 shows in greater detail the range of different options for positioning the moving flap 40 mounted in a suction hood 17*a* similar to the hood 17 of the suction damper 35. In this first variant embodiment, the control system 30 constituted by the control damper 35 forms the control system which has the better fineness of control compared with the moving flap 40.

In a second variant embodiment, as shown in FIGS. 5 and 6, the centrifugal blower apparatus 1 of the invention can be fitted with a combination of two other control systems 30, This variant embodiment differs from the above-described variant only in that the blower damper 35 is replaced by a system of control deflectors 60, the other control system 30 being formed by the moving flap 40. As well known in the prior art, the control deflector 60 is in the form of a series of blades 61 each in the form of a trapezium or a trapezoid, of thickness that may be constant or otherwise, and individually mounted about respective axes of rotation 62. The blades 61 are disposed side by side, preferably at uniform spacing from one another, in the suction channel 14 and they are mounted on a circle that is centered on the axis of the blower wheel 4. Advantageously, the blades 61 occupy positions that are inclined about their axes of rotation 62 relative to the plane in which the central disk 10 extends. Since each blade 61 is connected to a crank and connecting shaft assembly 22 and to the control member 21, it is possible to change the position and the pitch of each blade 61 and to do so synchronously for the entire set of blades 61 associated with the corresponding inlet 2. The dimensions and the shapes of each series of blades 61 are such that in a "closed" position, comprising to an angular position or pitch referred to as 0°, the peripheral ring that they form together closes the suction channel 14 substantially completely so that the flow rate of fluid admitted therethrough is substantially zero.

The blades 61 can take up any angular position lying in the range 0° to 105°, for example, and preferably in the range 0° to 90°, it being understood that from the above-defined 0° position, the direction in which the blades 61 open must ensure that the fluid flow rotates in the same direction as the centrifugal wheel 4. Thus, when the blades 61 are at a pitch lying in the range 90° to 105°, the suction flow rate will be at a maximum since it corresponds substantially to the thickness and mean cross-section in the vicinity of the blades 61 of the entire suction section of the channel 14.

In this second variant embodiment, the system of control deflectors 60 constitutes the control system presenting finer control, while the moving flap system 40 constitutes the coarser control system. Nevertheless, when fully open, the moving flap system 40 constitutes a system having lower headloss than the deflector control system 60.

Figure 7:
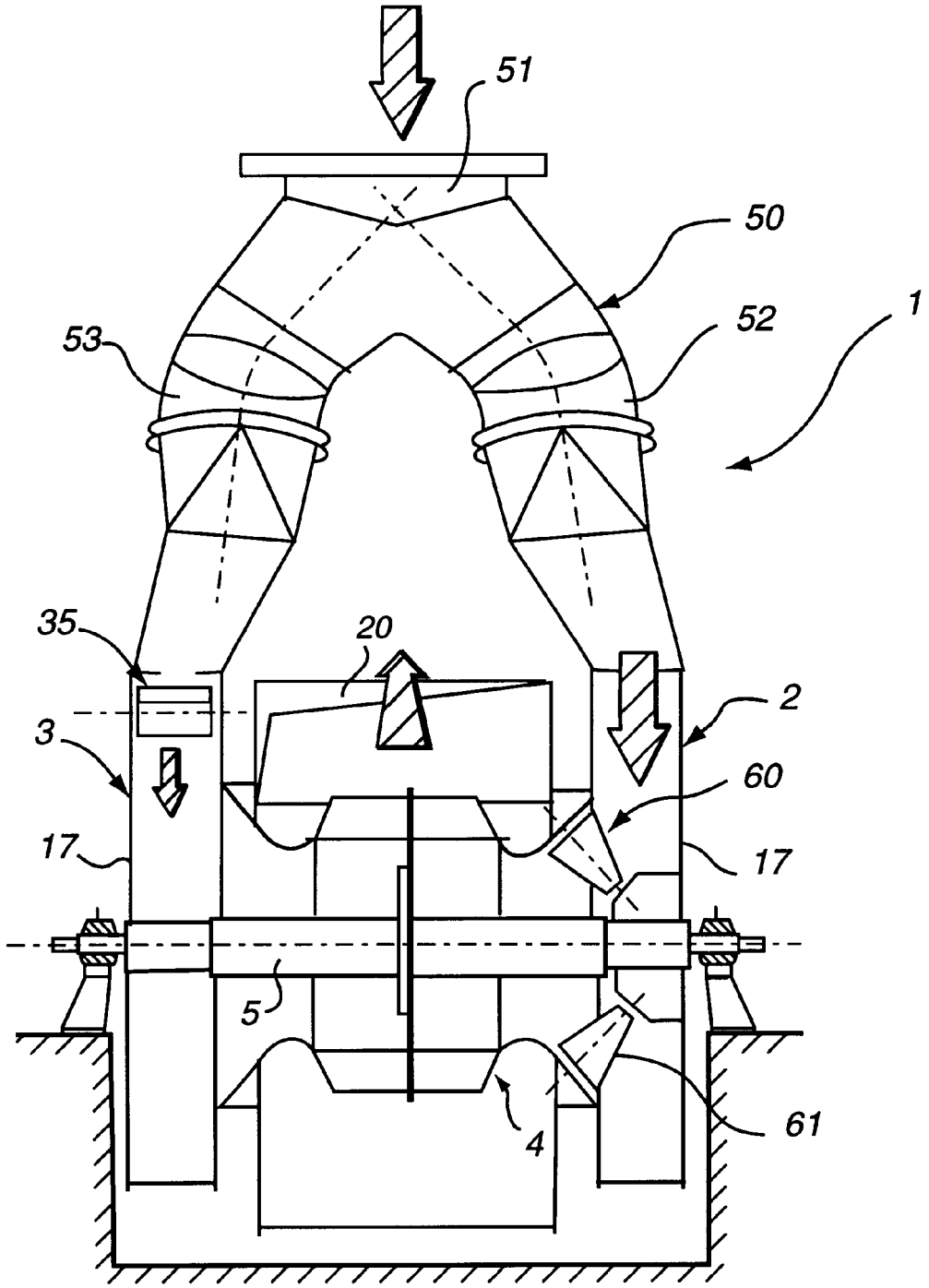
FIG. 7 is a longitudinal section of a third variant embodiment of the invention.

FIG. 7 shows a third variant embodiment of the invention whose general design is identical to that of the preceding variants, with the control system 30 associated with one inlet 2 being formed by a control deflector 60 while the other control system 30 associated with the other inlet 3 is in the form of a control damper 35. In such a configuration, the deflector control system 60 is the system having the finer control, with the control damper 35 being the system having coarser control.

FIG. 7 also shows an additional variant embodiment of the invention that differs from all the preceding variants by the presence of suction trunking 50 located upstream from the suction hoods 17 outside the main housing 13 of the centrifugal blower apparatus 1. In conventional manner, the suction trunking 50 comprises an inlet duct 51 that splits into two secondary ducts 52 and 53 which are respectively connected to the two inlets 2 and 3 via the suction hoods 17. In this variant embodiment, it is possible to use any combination of the above-described control systems 30. Advantageously, the secondary ducts 52 and 53 are of equal section so as to split the suction flow at this level into two suction flows that are substantially equal.

Without going beyond the ambit of the invention, it is even possible to envisage mounting one or both control systems 30 in one or both of the ducts 52, 53. This is particularly true of a system comprising a moving flap 40.

In a variant, it is also possible to make a centrifugal blower unit of the invention by eliminating the suction hood 17 for one or the other or both of the inlets 2 and 3.

Without going beyond the ambit of the invention, it is possible to combine any presently known flow rate control system 30 providing the way the systems are paired implies that they operate with different finenesses of control. Thus, it is possible to use a closure/control damper 35 having a plurality of blades, or a single blade, or indeed a single moving flap 40 of the rotary type or of the guillotine type. Control systems based on deflectors 60 can equally well be of the conical type, the cylindrical type, or the barrel type, for example.

In general, and as a further variant embodiment, the control systems 30 fitted to the two inlets 2 and 3 can be of the same type, e.g. two control deflectors 60 or two control dampers 35, providing that they differ in mechanical structure. Under such circumstances, the mechanical differences relate advantageously to the shapes of the systems and include variations in one or more of the following features of the blades: dimensions, number, shape.

In similar manner, it is possible to make centrifugal blower apparatuses that include units fitted with more than two fluid inlets.

The present invention also relates to a method of centrifugally blowing a fluid in which, continuously and successively:

- the fluid to be blown is sucked by a centrifugal wheel 4 through at least two inlets 2, 3 situated on either side of the wheel 4 so as to create at least one suction flow through the centrifugal blower apparatus 1;
- the suction flow rate is controlled in a manner that is asymmetrical between the inlets 2 and 3 by means of respective control systems 30 associated with each of the inlets 2 and 3; and
- the suction flow is expelled by the centrifugal wheel 4 via a delivery outlet 20.

The method of the invention consists in controlling the suction flow rate through each of the inlets 2 and 3 by means of the control system 30 associated with the inlet, the systems providing different relative fineness of control between the inlets 2 and 3.

Such a method consists in implementing a centrifugal blower apparatus 1 as described above, while monitoring and governing accurately in aerodynamic manner the rotary and asymmetrical air flow created by the control systems 30. Once the fineness of control of the control systems 30 differs by at least 5%, and preferably by an amount lying in the range 5% to 20%, the method of the invention is particularly advantageous when it includes following steps a) and b):

- step a): when the blower unit is operating under partial load lying substantially in the range 100% to 80% of its total suction flow rate, the method consists during step a) in providing control by means of one only of the control systems 30, that is capable of passing from its open position (corresponding to maximum and total suction flow rate) to its closed position, while the other system is kept constantly fixed in its open position; and
- step b): then when operating under partial load of less than 80% of the total suction flow rate, in providing control by means of the control system that was kept fixed in its open position during step a) with said system being closed progressively down to the value corresponding to the desired suction flow rate.

Figure 1:
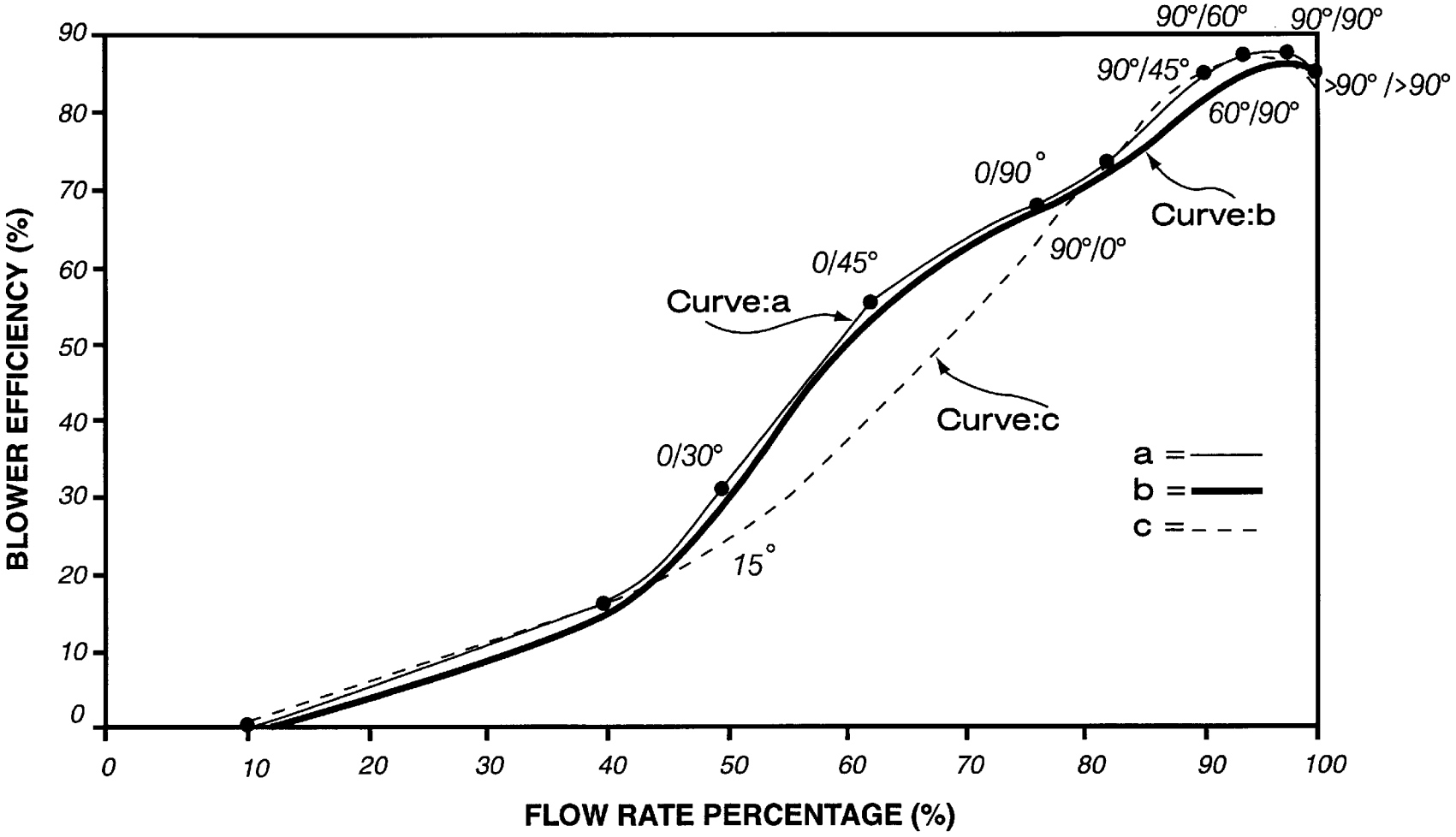
FIG. 1 gives comparative efficiency curves for a prior art centrifugal blower having two inlets fitted with symmetrically-oriented deflectors (curve c) and a two-inlet centrifugal blower of the invention (curves a and b)

By combining these two steps a) and b), it is possible to benefit from maximum efficiency at partial load, as shown by the graphs plotted in FIG. 1. Curve c shows how efficiency varies using a conventional method and system of the prior art with a blower having both of its inlets fitted with identical deflector control systems, with curve c representing in this case the apparatus having the best fineness of control. Curves a and b show the results and the improvements in efficiency obtained using the apparatus and method of the invention. Curves a and b coincide substantially for partial load operating rates lying in the range 10% to 80% of the total rate, and it is only for illustrative purposes that they are shown slightly offset in FIG. 1. An indication of the angular position of the blades 35*a* or 61, or of the moving fins or flaps 40 is given for each of the curves by a pair of numbers expressed in degrees, the first number (situated on the left) relating to the angular opening of the "course" control system and the second number (situated to the right) relating to the angular opening of the control system 30 having finer control. Comparison between the efficiencies obtained over all partial load ranges for a centrifugal blower having at least two inlets shows that the method and apparatus of the invention provide in this case results that are substantially equivalent even though slightly reduced for high operating rates (greater than 80% of the total rate), with results that are better when operating in a range of partial loads extending from 40% to 80%, even though the means implemented are of reduced cost and implementation is particularly simple.

In a first variant, the method of the invention consists in closing progressively during step a) the control system 30 having the coarser control, and then during step b) in progressively closing the other control system. This first variant implementation is expressed by curve b showing how efficiency varies for apparatus fitted with a blower damper 35 and an deflector control system 60. In this variant, the control damper 35 is given priority for partial blower loads lying in the range 80% to 100% of its total flow rate, with the blades 35*a* varying progressively from fully open to fully closed. Loses of efficiency observed relative to curve c are small, and more than compensated by the gains obtained in lower operating ranges, during which only the blades 61 are used for controlling flow rate.

In another particularly advantageous variant of the invention, as shown by curve a, the method consists during step a) in progressively closing the control system 30 having finer control while operating at partial loads in the high range (100% to 80% of total flow rate), and then in beginning step b) by simultaneously fully opening the control system that has finer control while completely and quickly closing the previously-open control system having coarser control. Step b) then continues by performing control using the control system 30 that has finer control. These operations are performed while maintaining the flow rate of the blower at a level that is substantially constant (about 80%), prior to continuing control over partial loads of less than 80%, still using the control system that provides better fineness of control. This second variant implementation is preferably performed by associating an deflector control system 60 with a damper control system of the type having a moving flap 40 that can take up only an open position or a closed position.

By operating in this way, the efficiency obtained with the invention is significantly greater than that obtained with prior art control techniques (curve c) when the blower is partially loaded at less than 80%, with the efficiency gains obtained on curve a (partial loadings in the range 80% to 100% of full flow rate) at high operating rates being substantially identical to prior art curve c, and better than curve b.

Consequently, it appears that the apparatus and method of the invention make it possible to benefit from maximum efficiency at all partial operating rates of the blower. By an appropriate selection of control systems associated in a single installation, it turns out to be possible to govern and model the shape of the control curve so as to better satisfy the requirements of the installation using the blower apparatus. The apparatus and method of the invention also make it possible to improve overall efficiency when the flow rate control systems are fully open since it uses at least one control system, such as a bladed control damper 35 or a moving flap 40 that gives rise to significantly smaller headloss when fully open than the headloss generated by an deflector control system 60. The invention also makes it possible to reduce the overall cost of the complete control system without reducing its effectiveness, and indeed increasing its effectiveness since even at high operating rates the efficiencies obtained are comparable to or better than those obtained using presently known systems.

I claim:

1. A method of centrifugally blowing a fluid by means of a blower unit capable of operating under partial load, comprising the following steps which are performed continuously and successively:

i) operating a centrifugal wheel so as to suck the fluid to be blown in through at least two inlets situated on either side of the wheel and thereby create at least one suction flow;

(ii) asymmetrically controlling the suction flow rate between the inlets by means of respective control systems associated with the inlets to enable the blower unit to operate at the partial load; and (iii) expelling the suction flow by the centrifugal wheel via a delivery outlet, wherein step (ii) includes the step of controlling the suction flow rate by means of control systems having different relative fineness controls for each inlet so as to provide a control curve shape which is optimized at all partially loaded operating rates.

2. A method according to claim 1, wherein the control systems differ by fineness of control amounting to at least 5%.

3. A method according to claim 1, comprising the following steps a) and b):

a) for partial loading of the blower unit lying in the range substantially 100% to 80% of the total suction flow rate, performing control using a single control system capable of passing respectively from an open position to a closed position while the other system is maintained constantly fixed in an open position; and b) then, for operating at a partial load of less than 80% of the total flow rate, performing control at least by means of the other system being held fixed in its open position during step a), said other system being closed progressively to the value corresponding to a desired flow rate.

4. A method according to claim 3, wherein during step a), progressively closing the control system having coarser control; and then during step b), subsequently progressively closing the other control system is.

5. A method according to claim 3, wherein during step a), progressively closing the control system having finer control;

then, beginning step b) by simultaneously causing the control system having finer control to be fully opened while fully closing the control system having coarser control; and in continuing step b), providing control by the control system having finer control.

6. A method according to claim 5, wherein the system having coarser control is a flap capable of taking up only a closed position or an open position.

7. A method according to claim 1, wherein the control systems differ in fineness of control by 5% to 20%.

8. A centrifugal blower apparatus capable of operating at partial load and including:

a blower wheel;

a drive system for rotating said blower wheel;

at least one delivery outlet and at least two fluid inlets disposed on either side of said blower wheel, control systems each being operatively associated with a respective one of said inlets for controlling fluid suction flow and for establishing suction flow rates that are asymmetrical between the inlets to enable said apparatus to operate at said partial load, wherein said control systems are not identical, and differ from one another in their mechanical structures and their characteristics relating to fineness of control so as to provide a control curve shape which is optimized at all partially loaded operating rates.

9. Apparatus according to claim 8, wherein the control system associated with one of said inlets includes a fine control system having a fine control, while the control system associated with another of said inlets includes a coarse control system of lower quality, having coarse control, wherein said fine and coarse control systems differ in fineness of control by at least 5%.

10. Apparatus according to claim 9, wherein the coarse control system is a system that, when fully open, provides lower headloss than does the fine control system.

11. Apparatus according to claim 9, wherein said first and second control systems differ in fineness of control by 5% to 20%.

12. Apparatus according to claim 8, wherein the control system associated with one of said inlets is formed by a control deflector, and wherein the control system associated with another one of said inlets is a control damper.

13. Apparatus according to claim 8, wherein the control system associated with one of said inlets is formed by a control deflector, and wherein another one of said inlets is provided with one of a closure-control moving flap and a control damper having a single blade.

14. Apparatus according to claim 8, wherein the control system associated with one of said inlets is formed by a control damper, and wherein another one of said inlets is provided with a closure-control moving flap.

15. Apparatus according to claim 1, including suction trunking that splits into two secondary ducts respectively connected to the two inlets.

16. Apparatus according to claim 15, wherein at least one of the control systems is mounted in the suction is trunking.

17. Apparatus according to claim 1, having two fluid inlets.

18. An industrial blower fitted with apparatus according to claim 1.

* * * * *